US006961968B2

(12) United States Patent
Clapper et al.

(10) Patent No.: US 6,961,968 B2
(45) Date of Patent: Nov. 8, 2005

(54) BASSINET AND CHANGING TABLE ASSEMBLY

(75) Inventors: Joshua E. Clapper, King of Prussia, PA (US); Cindy Berkey, Honey Brook, PA (US); Richard H. Mathews, Phoenixville, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 10/808,592

(22) Filed: Mar. 25, 2004

(65) Prior Publication Data

US 2005/0210581 A1 Sep. 29, 2005

(51) Int. Cl.[7] ..... A47D 7/00; A47D 3/00; A47D 13/00

(52) U.S. Cl. ..... 5/93.1; 5/655

(58) Field of Search ..... 5/655, 94, 2.1, 5/93.1, 97, 101, 105; D6/384, 390

(56) References Cited

U.S. PATENT DOCUMENTS 2,280,913 A * 4/1942 Hummel et al. ..... 5/2.1
2,537,539 A * 1/1951 McLendon et al. ..... 5/95
2,654,098 A * 10/1953 Heyward ..... 5/2.1
2,752,614 A * 7/1956 Hayward ..... 5/93.1
2,846,700 A * 8/1958 De Puy ..... 5/424
3,631,547 A * 1/1972 Massie ..... 5/93.1
D319,931 S * 9/1991 Vuong et al. ..... 54/41.1
5,819,340 A * 10/1998 Kelly ..... 5/95
6,192,535 B1 2/2001 Warner, Jr. et al.
6,233,759 B1 5/2001 Warner, Jr. et al.
6,543,070 B2 4/2003 Longenecker et al.
6,704,949 B2 3/2004 Waldman et al.
2003/0177574 A1 9/2003 Waldman

OTHER PUBLICATIONS

"Triad- 3 in 1 Bedside Bassinet 5730FKB—French Bear", Graco, 1 pp., Apr. 24, 2001.
"Triad 3 in 1 Bedside Bassinet Deluxe Item #5750SAR Fashion- Saratoga", Graco., 1 pp., Aug. 31, 2002.
"3 in 1 Deluxe Bedside Bassinet", Graco, 1 pp., 2002.

* cited by examiner

*Primary Examiner*—Alexander Grosz
(74) *Attorney, Agent, or Firm*—Foley & Lardner LLP

(57) ABSTRACT

A bassinet and changing table assembly includes a frame, a changing table mounted to the frame, and a bassinet releasably mounted to the changing table and/or the frame so that the bassinet is positioned over the changing table. Hence, the diaper changing activity is separated from the child sleeping area.

7 Claims, 7 Drawing Sheets

BASSINET AND CHANGING TABLE ASSEMBLY

FIELD OF THE INVENTION

This invention relates to a bassinet and changing table assembly. More specifically, this invention relates to an assembly in which a bassinet is removably mounted over a changing table.

BACKGROUND OF THE INVENTION

Bassinets provide a safe environment in which an infant child can rest. Typically, the bassinet is a child sleeping assembly that has a flat floor on which is a mattress pad with a fitted sheet. The child lies in the assembly. Usually a bassinet can accommodate a child until the child is about three months old. Some caregivers during that time change the infant's diaper while the infant is in the bassinet. Occasionally, however, this practice fouls the nest.

There is a need in the art for an improved child sleeping apparatus to separate the diaper changing activity from the child sleeping area.

SUMMARY OF THE INVENTION

A bassinet and changing table assembly includes a frame and a changing table mounted to the frame. A bassinet is releasably mounted to the changing table and/or the frame. Preferably, the changing table also includes a safety strap to hold the infant on the changing table.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

Figure 1:
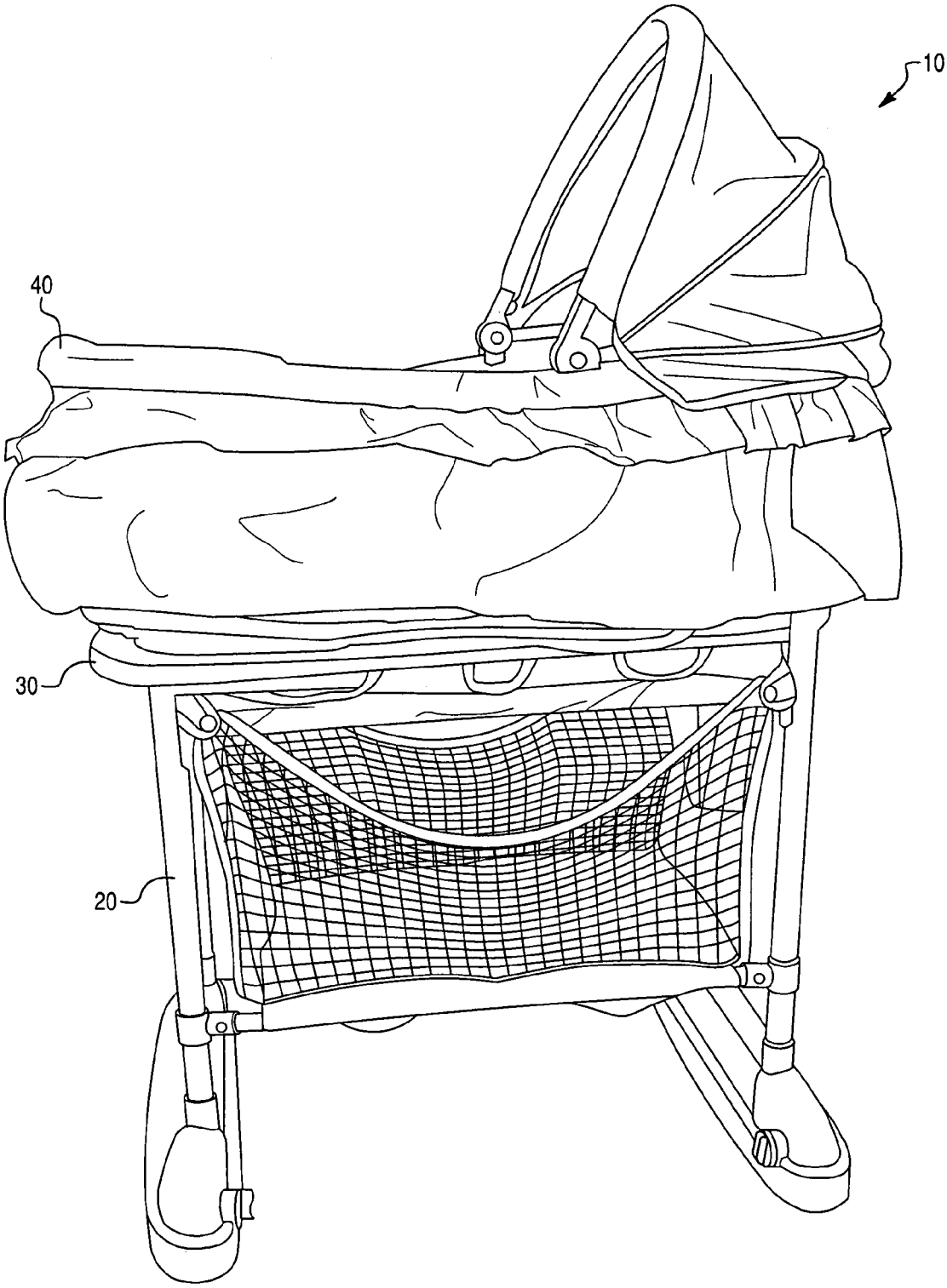
FIG. 1 is a perspective view of an embodiment of the bassinet and changing table assembly.
Figure 2:
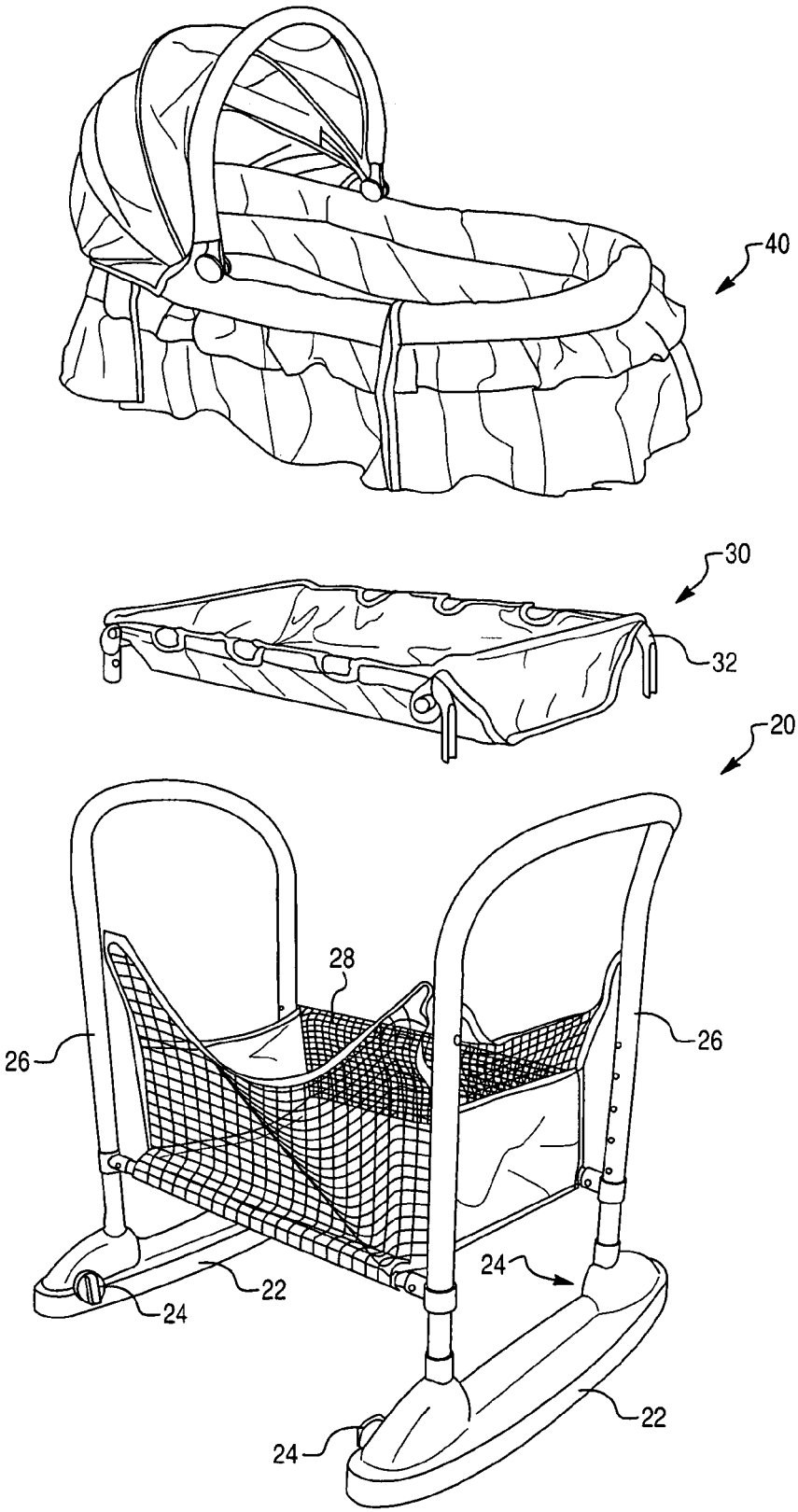
FIG. 2 is an exploded view of the bassinet, the changing table, and the frame.
Figure 7:
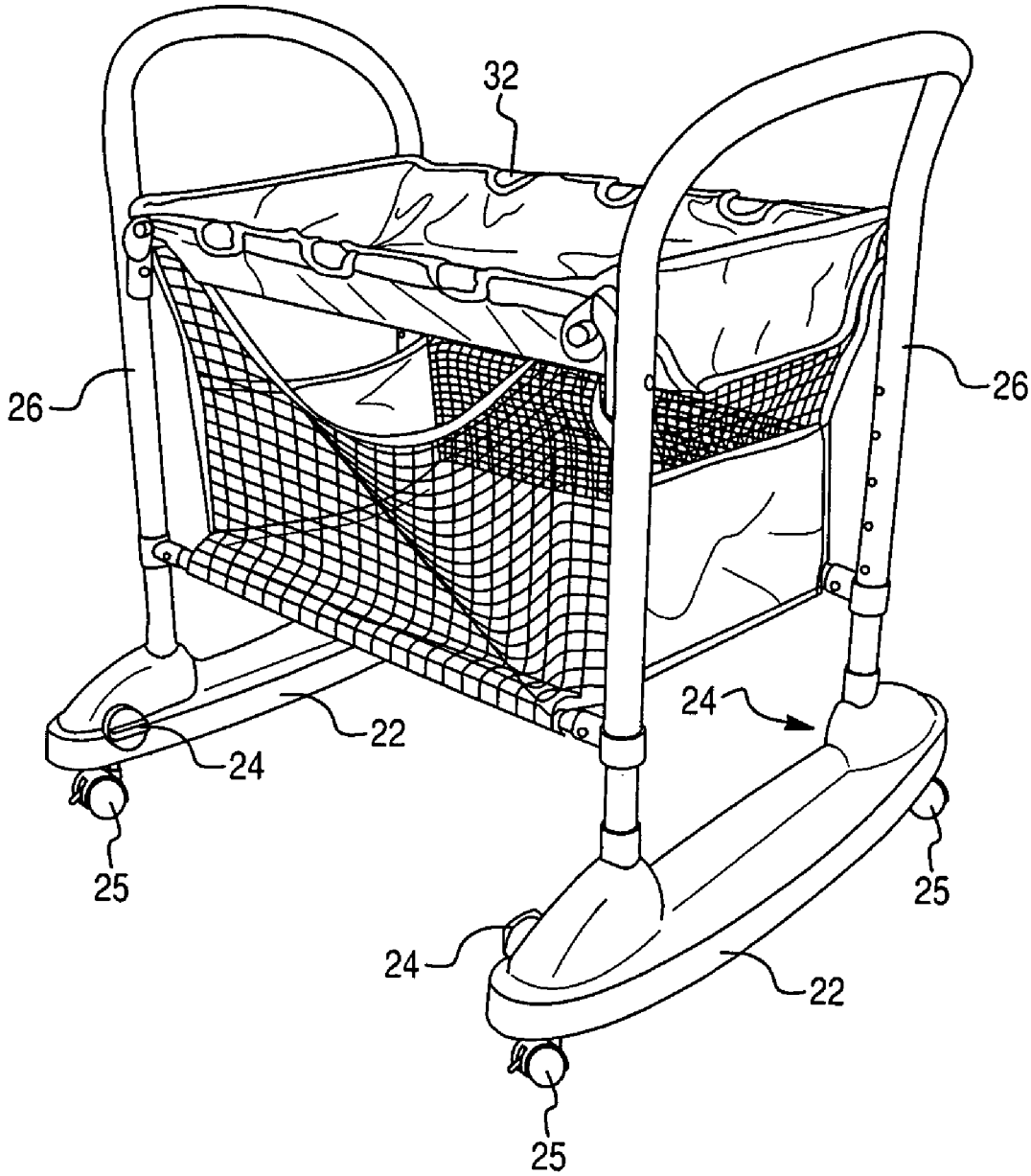
FIG. 7 is a perspective view of an embodiment of the bassinet and changing table assembly, with the bassinet removed.

FIGS. 1 and 2 illustrate an embodiment of a changing table and bassinet assembly that includes a frame 20, a changing table 30 mounted to frame 20, and a bassinet 40 releasably mounted to changing table 30 and/or to frame 20. The assembly may be used as a bassinet 40, as shown in FIG. 1, or as a changing table 30, as shown in FIG. 7. In this assembly, the diaper changing activity is separated from the child sleeping area. Further, even after a child has grown too big for the bassinet 40, the assembly can still be employed as a diaper changing station by simply removing the bassinet 40 from the assembly.

In one embodiment, frame 20 includes a pair of base members 22 that can each include a pair of retractable and lockable casters or rollers 25 and a pair of actuators 24 for controlling the positioning of the casters 25. A pair of U-shaped uprights 26 may be attached to base members 22, and a storage basket 28 can be connected to uprights 26. The uprights 26 and the storage basket 28 can be adjusted to be at selected heights off the floor. That is, the legs of the U-shaped uprights 28 can be telescoping legs that can be height adjusted. When the changing table and bassinet assembly is configured to function as a bassinet, as shown in FIG. 1, the casters 25 can be retracted within the base members 22, and the assembly can rest on the base members 22. The lower, floor-contacting surface of the base members 22 can be curved so that the base members 22 operate as rockers, enabling a caregiver to rock the bassinet back and forth. When the assembly is configured to function as a changing table, as shown in FIG. 7, the casters 25 can be exposed and locked to stabilize the assembly while the child's diaper is being changed. In addition, in the changing table configuration, the uprights 26 can be adjusted to their highest position to elevate the changing table surface closer to the caregiver.

Figure 3:
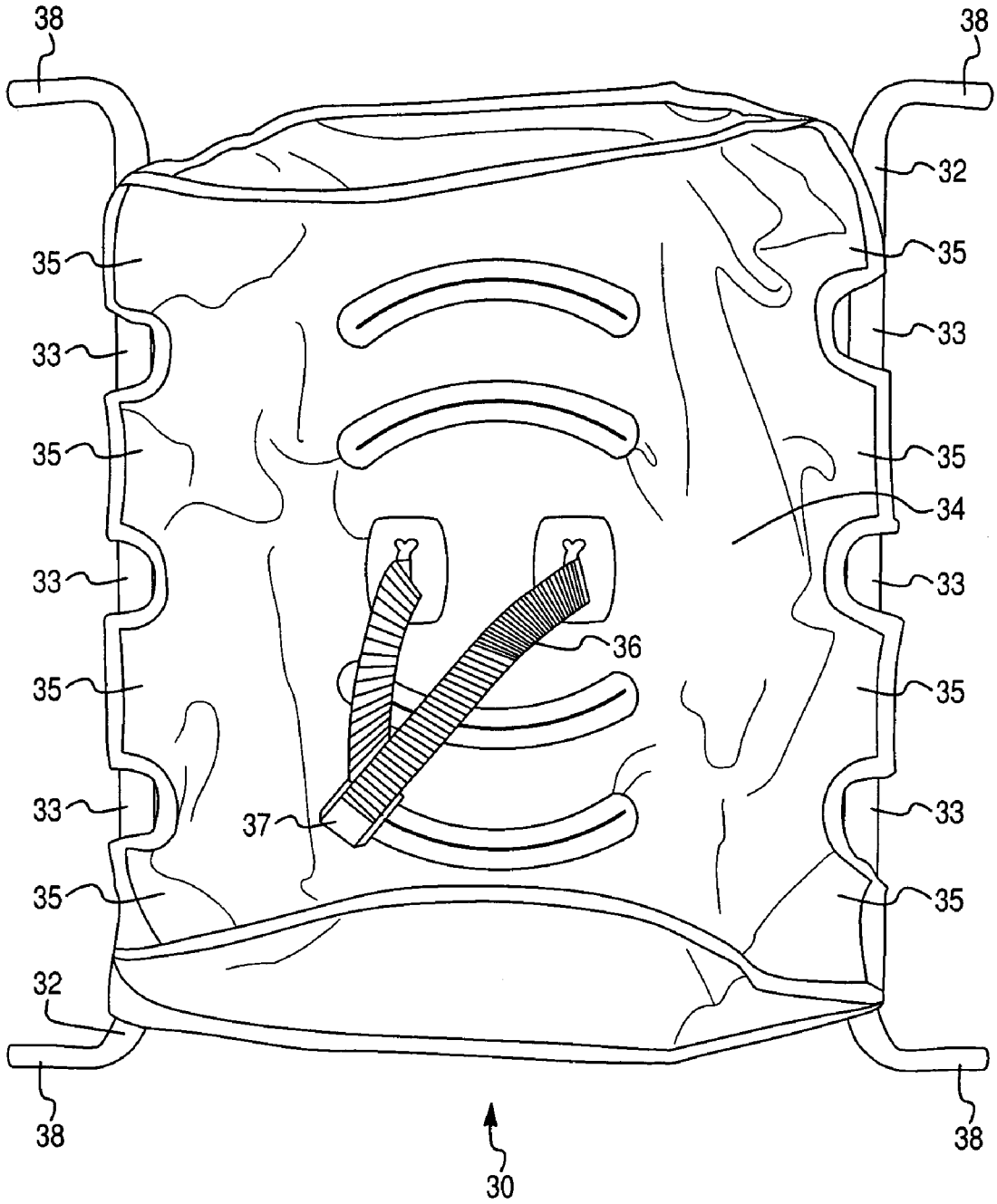
FIG. 3 is a top view of the changing table.

As shown in FIGS. 2 and 3, one embodiment of changing table 30 includes a pair of rails 32 supporting a diaper changing area 34. The diaper changing area 34 may be made of a vinyl material that is water and stain proof. The diaper changing area 34 can include wings 35 that wrap around the rails 32 for securement to an underside of the diaper changing area 34 via snaps or the like. Alternatively, the sides of the diaper changing area 34 can include sleeves through which the rails 32 can be fed to secure the diaper changing area 34 to the rails 32. To secure the baby to the changing table 30, one embodiment includes a child safety belt or strap 36 with ends that are fastened together by snap or buckle 37. Changing table 30 may include a rigid support board.

In one embodiment, the changing table area 34 can comprise a vinyl top panel sewn to a fabric bottom panel, and the fabric bottom panel can include wings or sleeves to mount the changing table area 34 to the frame 20. A rigid fiberboard support panel can be sewn between the vinyl top panel and the fabric bottom panel to provide a flat support surface on which to change the child. A nylon safety strap with a plastic buckle can be threaded from beneath the vinyl top panel, through the panel, to keep the child in place during the changing process.

Changing table 30 is fixed to frame 20 by, for example, screwing ends 38 of rails 32 to uprights 26. Also, changing table 30 may be adapted to receive at, for example, portions 33 of rails 32 bassinet mounting fixtures 52.

Figure 4:
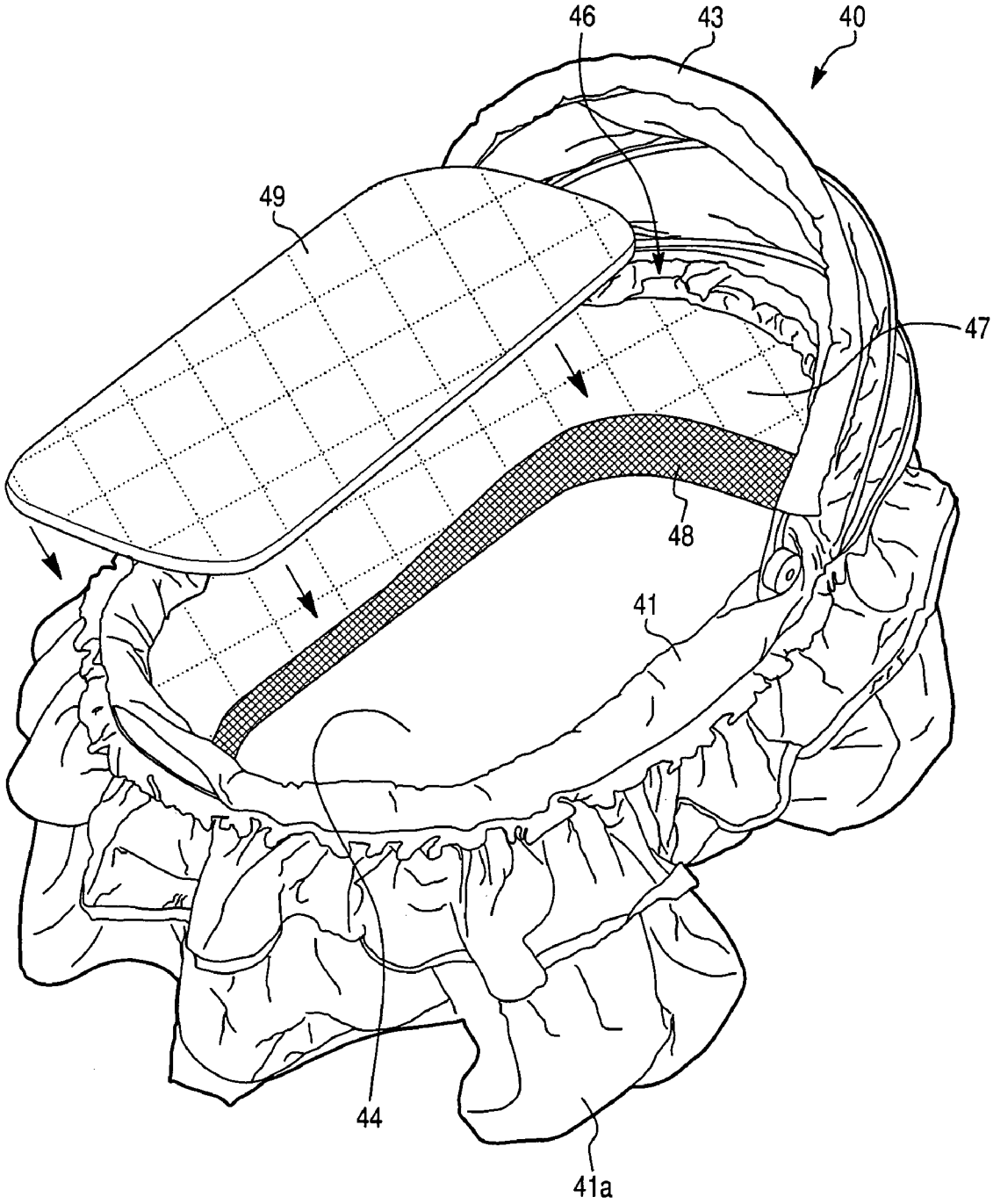
FIG. 4 is a partially exploded, top perspective view of an embodiment of the bassinet.
Figure 5:
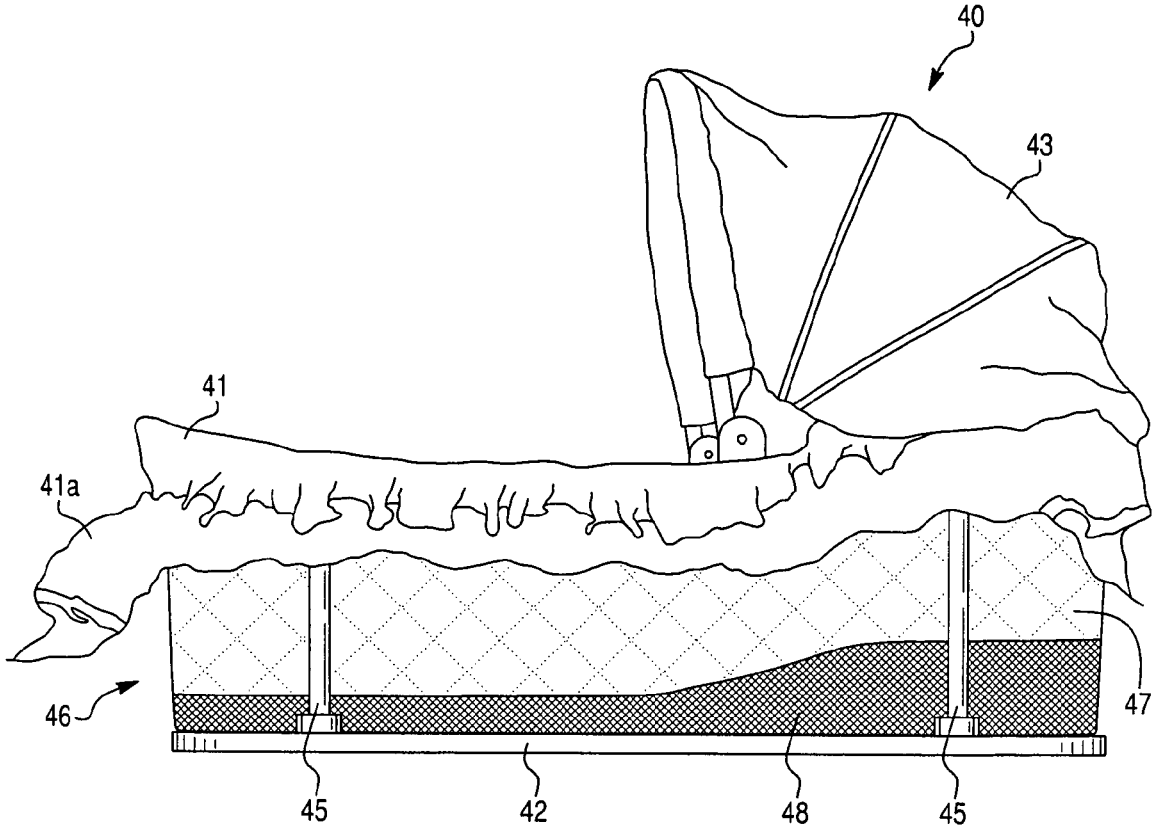
FIG. 5 is a side elevation view of the bassinet of FIG. 4 with a portion of the bassinet cover cut away.
Figure 6:
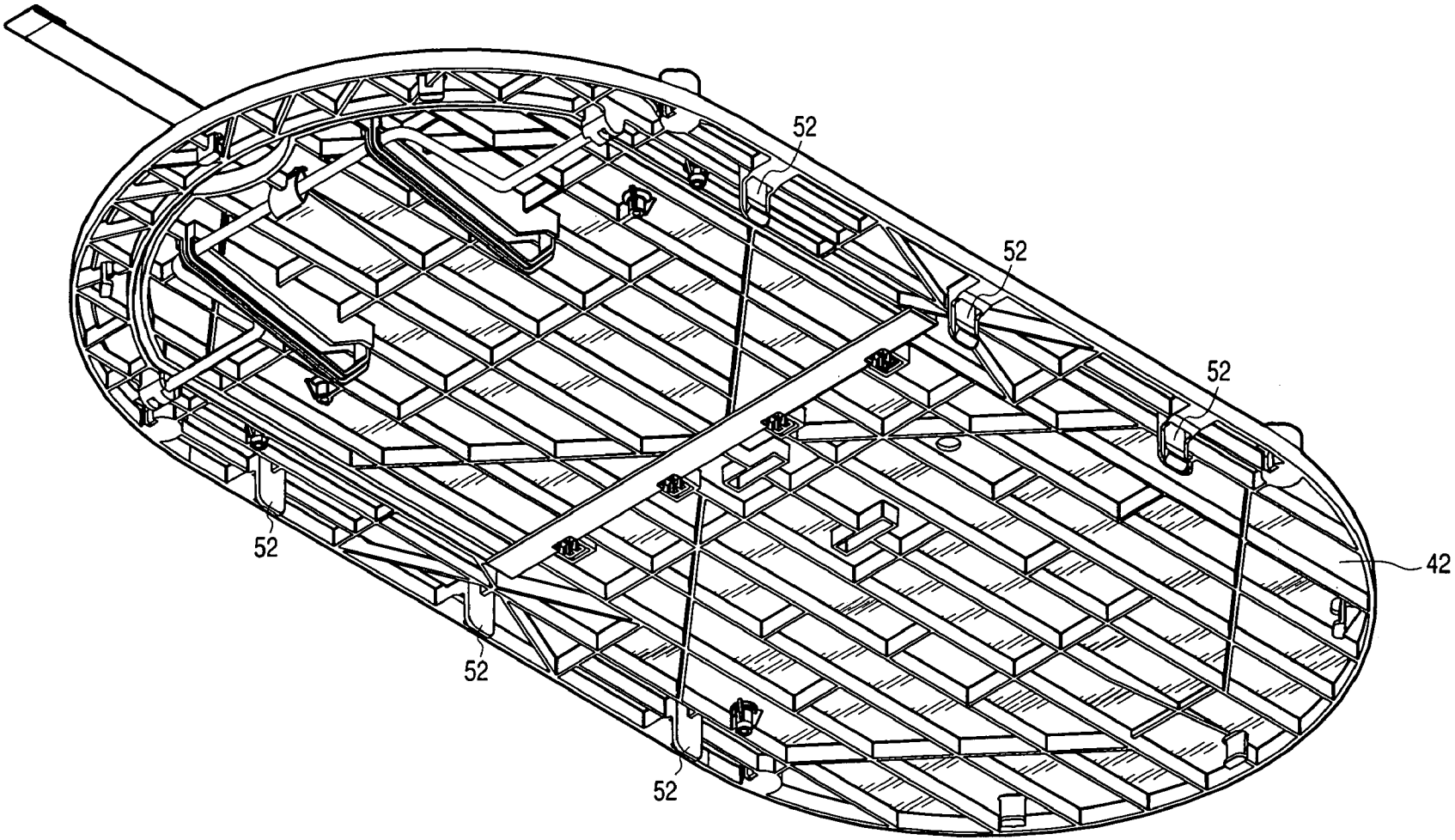
FIG. 6 is a bottom perspective view of an embodiment of the bassinet floorboard.

FIGS. 4–6 show a free-standing bassinet 40 that includes a fabric bassinet cover 41 (with outer skirt 41*a*) and a bassinet frame (obscured in FIG. 4 by the bassinet cover). The bassinet 40 also can include an inclinable floor as described in co-pending application Ser. No. 10/808,593, filed Mar. 25, 2004, which is hereby incorporated by reference.

The bassinet frame is mounted to floorboard 42 and serves to support the bassinet cover 41. The frame can include four posts 45 and an upper rail assembly.

The bassinet cover 41, which is configured to provide a child containment structure when mounted to the frame, has a floor 44 and a sidewall 46 connected to the floor 44 to define a unitary structure with the floor 44. Optionally, bassinet 40 may include mattress pad 49 positioned on floor 44. In one exemplary embodiment, the sidewall 46 includes a single, oval-shaped side panel 47 formed of an air-restricting material, as well as a ventilation panel 48 positioned between the floor 44 and the side panel 47. The ventilation panel is described more fully in co-pending application Ser. No. 10/808,597, filed Mar. 25, 2004, which is hereby incorporated by reference.

As shown in FIG. 6, floorboard 42 of bassinet 40 can include mounting fixtures 52 to releasably mount the bassinet 40 to the changing table 30. Preferably, mounting fixtures 52 are C-shaped brackets that can snap onto rails 32, or they may be cut-out portions of a cross-piece extending from one side of the floorboard to the other. Mounting fixtures 52 are adapted to engage rails 32 at several locations 33 when desired to securely mount bassinet 40 to changing table 30; mounting fixtures 52 are also adapted to be released from rails 32 when desired. Either instead of or in addition to mounting fixtures 52, bassinet 40 can include straps (for example, hook and loop straps, such as VELCRO® brand, or snap-fastened straps) to mount the bassinet 40 to frame 20 and/or to changing table 30.

The preferred embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A bassinet and changing table assembly, comprising:
a frame;
a changing table mounted to the frame;
a safety strap attached to the changing table; and
a bassinet releasably mounted to at least one of the changing table and the frame;
wherein the bassinet is positioned over the changing table.

2. A bassinet and changing table assembly according to claim 1, wherein the frame includes a pair of base members and a pair of adjustable uprights mounted to respective base members.

3. A bassinet and changing table assembly according to claim 1, wherein the frame includes a pair of base members, and each of the base members includes a pair of retractable casters.

4. A bassinet and changing table assembly according to claim 1, wherein the frame includes a pair of base members, and the base members have a curved floor-contacting surface.

5. A bassinet and changing table assembly according to claim 1, wherein the changing table comprises vinyl material.

6. A bassinet and changing table assembly according to claim 1, wherein the changing table comprises fabric material.

7. A bassinet and changing table assembly, comprising:
a frame;
a changing table mounted to the frame;
a safety strap attached to the changing table; and
a bassinet including a floorboard and a frame mounted to the floorboard, the bassinet being releasably mounted to the changing table,
wherein the bassinet is positioned over the changing table.

* * * * *